United States Patent [19]

Ichikawa

[11] Patent Number: 4,724,292

[45] Date of Patent: Feb. 9, 1988

[54] MICROWAVE OVEN WITH FOOD WEIGHT MEASUREMENT

[75] Inventor: Noboru Ichikawa, Yamatokoriyama, Japan

[73] Assignee: Sharp Kabushiki Kaisha, Osaka, Japan

[21] Appl. No.: 887,969

[22] Filed: Jul. 21, 1986

Related U.S. Application Data

[63] Continuation of Ser. No. 732,562, May 10, 1985, abandoned.

[30] Foreign Application Priority Data

Jul. 11, 1984 [JP] Japan ..... 59-145002

[51] Int. Cl.[4] ..... H05B 6/68

[52] U.S. Cl. ..... 219/10.55 B; 219/10.55 F; 219/518; 177/4

[58] Field of Search ..... 219/10.55 B, 10.55 F, 219/10.55 G, 10.55 R, 506, 518; 177/4, 5, 6, 25

[56] References Cited

U.S. PATENT DOCUMENTS

| | | | |
|---|---|---|---|
| 3,890,825 | 6/1975 | Davis | 219/10.55 B X |
| 4,276,948 | 7/1981 | Nichols | 219/10.55 B X |
| 4,390,768 | 6/1983 | Teich et al. | 219/10.55 B |

*Primary Examiner*—Philip H. Leung

*Attorney, Agent, or Firm*—Birch, Stewart, Kolasch, & Birch

[57] ABSTRACT

A microwave oven is disclosed including a turntable inside a cooking chamber, the turntable being provided with a weight detection device, a weight measuring device on a digital display for displaying a result of the food weight measurement produced by the weight measuring device. The word "approximately" or another appropriate term is also displayed together with a measured net weight value.

4 Claims, 3 Drawing Figures

MICROWAVE OVEN WITH FOOD WEIGHT MEASUREMENT

This application is a continuation of application Ser. No. 732,562 now abandoned filed on May 10, 1985 and now abandoned.

BACKGROUND OF THE INVENTION

The present invention is a microwave oven provided with a food weight measuring function and an improved digital display. Recently, many modern microwave ovens have been introduced into the art which are provided with a food weight measuring function. Some models are also provided with a device capable of automatically computing the cooking time based on the automatic weight measurement. They also have digital displays to help the operator manually calculate the necessary cooking time.

OBJECT AND SUMMARY OF THE INVENTION

In actuality, food weight measurements rarely require a need for extremely high accuracy. However, since the digital display shows a weight value, there should be no difference between the measured value displayed and the actual food weight. As a result, the latest microwave ovens are obliged to introduce highly precise but expensive measuring units. The present invention provides an efficient microwave oven incorporating a simple, economical digital display, a food weight detection device, and food weight measuring device. The microwave oven in the preferred embodiment of the present invention is comprised of a turntable inside of the cooking chamber with a means of detecting food weight; a means for measuring food weight; a means of digitally displaying the food weight measurement; and a means of causing the digital display to also display the word "approximately" or another appropriate term.

The preferred embodiment of the present invention is comprised of the above configuration. But because the display can show the word "approximately" or another appropriate term, the microwave oven embodied by the present invention does not require highly precise food weight measurement. Instead, only a simple, low-cost weight measuring device need be used.

DETAILED DESCRIPTION OF THE PREFERRED EMBODIMENT

Figure 1:
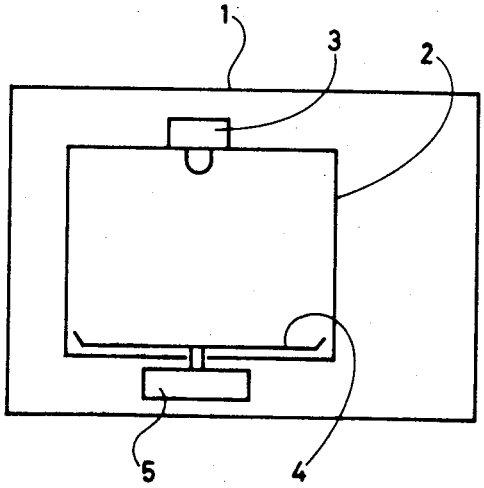
FIG. 1 shows a front view of the simplified configuration of the microwave oven reflecting the preferred embodiment of the present invention.
Figure 2:
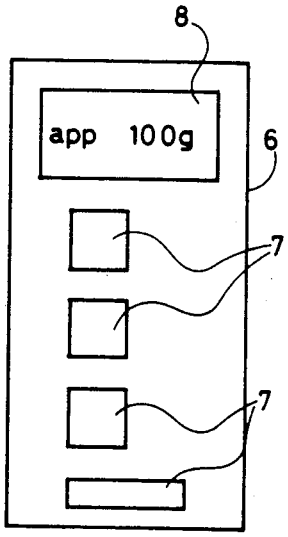
FIG. 2 shows an enlarged front view of the key constituents of the preferred embodiment.
Figure 3:
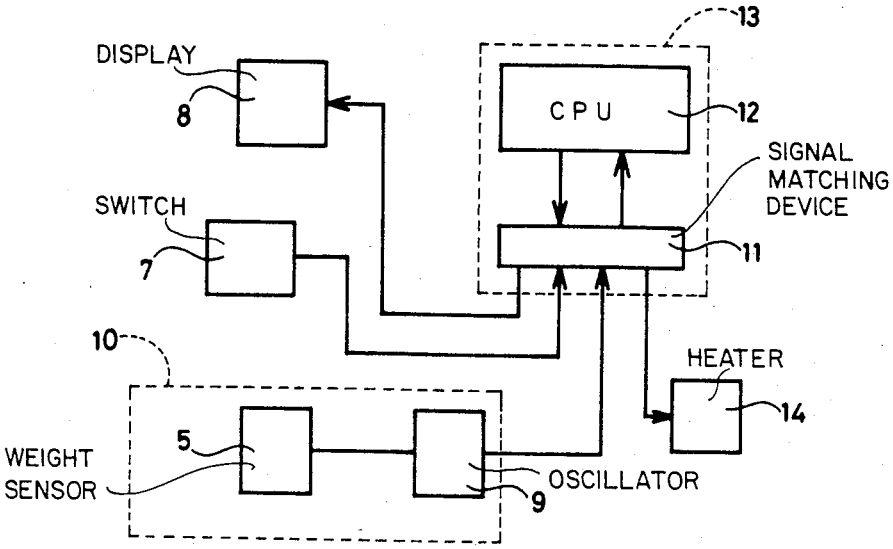
FIG. 3 is a simplified block diagram of the electric circuit needed to implement the food weight measurement.

Referring now to the attached drawings, the preferred embodiment of the present invention is described below. It should be understood, however, that the scope of the present invention is by no means limited to the following embodiments. FIG. 1 shows a simplified front view of the entire configuration of the microwave oven embodied by the present invention. Reference number 1 indicates a housing unit incorporating a cooking chamber 2. A magnetron 3 is provided in the upper part of the cooking chamber 2, whereas a turntable 4 is mounted on the lower part of the cooking chamber 2. Reference number 5 indicates a food weight sensor which constitutes part of the food weight detection device and is integrally secured to the lower part of the turntable 4. FIG. 2 shows a control panel 6 provided at the lateral position of the microwave oven's front panel, while a variety of functional switches 7 are provided on the control panel 6. A window-shaped display 8 digitally displays the result of the food weight measurement by using a liquid crystal element and is provided above the control panel 6. Referring now to FIG. 3, an electric circuit for food weight measurement embodied by the present invention is described below. Reference number 9 indicates an oscillator utilized in a food weight device 10 together with a food weight sensor 5. The oscillator 9 converts any variation of the oscillated frequency so as to cause the weight detection device 10 to output weight signals.

Reference number 11 indicates a signal matching device and reference number 12 indicates a central processing unit (CPU). The signal matching device and CPU together form weight measuring device 13. The central processing unit 2 is comprised of a single-chip microcomputer incorporating a memory element. Reference number 14 indicates a heater. Switch 7 shown in FIG. 2 is set to the second position from the top, which activates the food weight measuring operation. The food weight measuring procedure is described below. First, the initial weight Wo of the turntable 4 is measured. Pressing switch 7 then causes the turntable 4 to be weighed with nothing on it. This causes the oscillator 9 to generate an oscillation frequency signal, which is then transmitted to the central processing unit 12 via the signal matching device 11. The initial weight W0 of the turntable 4 is thus calculated. The initial weight W0 is then memorized by the memory element of the central processing unit 12. After placing food on the turntable 4 and pressing switch 7 to start the food weight measurement, the total weight W1 of the turntable and food is measured by repeating the same procedure described above in connection with the initial weight measurement. The central processing unit 12 then subtracts the initial weight Wo from the total weight W1 to determine the net weight of the food. The central processing unit then transmits the resulting net weight to the display device 8 via the signal matching device. Finally, the display device 8 displays the net weight value of the measured food together with the word "approximately." The word "approximately" may also be displayed, for example, simply by illumination.

As explained above, the word "approximately" or another appropriate term is always displayed together with the measured net weight value of the food. Therefore, a highly precise food weight measurement is not requied or expected. For example, a food weight sensor comprised of two simply constructed sheet-shaped electrodes having variable distance and capacitance may be used.

The invention being thus described, it will be apparent that the same may be varied in many ways. Such variations are not to be regarded as a departure from the spirit and scope of the invention, and all such modifications as would be obvious to one skilled in the art are intended to be included within the scope of the following claims.

What is claimed is:

1. A microwave oven comprising:

a cooking chamber having a turntable located therein;

a microwave energy source for supplying microwave energy to said cooking chamber;

weight detection means for detecting the weight of said turntable with or without food thereon and outputting a weight detection signal representative thereof;

switching means for controlling weight measurement operations of said turntable;

food weight measuring means, responsive to said food weight detection signal and said switching means, for determining an initial weight value of said turntable without food thereon, determining a total weight value of said turntable having food thereon, and subtracting said initial value from said total value to determine a net weight food value; and means for displaying said net weight food value along with a qualifying term to indicate the inexactness of said net weight food value, said means for displaying being operative in response to the determination of said net weight food value.

2. A microwave oven according to claim 1 wherein said weight detection device includes a weight sensor for outputting a signal in response to the presence of food weight on said turntable and an oscillator for converting any variation received from the sensor and for outputting said weight detection signal.

3. A microwave oven according to claim 1, wherein said food weight measuring means includes a signal matching device for inputting signals from said switching means and said food weight detection means into a central processing unit and for outputting signals from said central processing unit into said means for displaying and said microwave energy source.

4. A microwave oven according to claim 3, wherein said central processing unit is for performing at least the net weight food value calculations.

* * * * *